United States Patent [19]

Brass et al.

[11] 4,368,993

[45] Jan. 18, 1983

[54] REPLACEABLE ASSEMBLY FOR MULTICOLOR PRINTING

[75] Inventors: Robert L. Brass, Westport, Conn.; John F. Frega, Holmdel, N.J.

[73] Assignee: Centronics Data Computer Corporation, Hudson, N.H.

[21] Appl. No.: 259,459

[22] Filed: Apr. 30, 1981

[51] Int. Cl.[3] ..... B41J 35/14; B41J 35/20

[52] U.S. Cl. ..... 400/216.2; 400/217; 400/229

[58] Field of Search ..... 400/211, 216, 217, 229, 400/216.1, 216.2; 401/110–112

[56] References Cited

U.S. PATENT DOCUMENTS

| | | | |
|---|---|---|---|
| 605,032 | 5/1898 | Unz | 400/217 |
| 2,048,188 | 7/1936 | Clarkson-Jones | 400/217 |
| 2,154,058 | 4/1939 | Vollans | 400/217 |
| 3,200,740 | 8/1965 | Schaller et al. | 400/216.1 |
| 3,272,305 | 9/1966 | Page | 400/216 |
| 3,810,701 | 5/1974 | Freccero et al. | 401/110 |
| 3,941,990 | 3/1976 | Anton | 401/110 |
| 4,073,371 | 2/1978 | Prager | 400/216.2 |
| 4,280,767 | 7/1981 | Heath | 400/216.2 |

OTHER PUBLICATIONS

Mathews "One Handed Print Element Latch Device" IBM Technical Disclosure Bulletin, vol. 23, No. 2, pp. 435–436, 7/80.

*Primary Examiner*—William Pieprz
*Attorney, Agent, or Firm*—Kenway & Jenney

[57] ABSTRACT

A computer controlled impact printer has a replaceable ribbon guide assembly mounted on a printhead. The assembly is movable vertically between at least two stable positions. Each position places a differently colored portion of the ribbon between the printhead and a sheet of paper. Rotation of a pair of opposed cams changes the vertical position of the assembly. One cam is fixed and the other is rotatable by a pawl operating on a ratchet wheel secured to the cam. The pawl is mounted on the assembly for a longitudinal sliding movement. Movement of the printhead to a preselected position at or near one end of its travel path drives the pawl into an abutment surface which displaces the pawl a predetermined distance. The displacement rotates the movable cam from one stable vertical position to another. The mating cam surfaces preferably have matching sawtooth configurations with recesses formed in the tips of the teeth of one cam. The cams are biased towards one another and the pawl is biased towards the abutment surface.

12 Claims, 7 Drawing Figures

REPLACEABLE ASSEMBLY FOR MULTICOLOR PRINTING

BACKGROUND OF THE INVENTION

This invention relates generally to printers. More specifically, it relates to an attachment for a computer controlled impact printer that allows a conventional one-color printer to print in any of two or more colors.

Many conventional printers, particularly printers designed for use as computer output devices, are impact printers where a printhead impacts a character against an inked ribbon and an underlying sheet of paper. Typically the printhead translates back and forth across the paper under the control of a host computer or data source.

One limitation on conventional printers is that they normally are capable of printing in only one color, typically black. The ribbon, if a ribbon is used, carries ink of only one color. While printers are available which can print in more than one color—with changes between colors occurring during a continuous printing operation—these devices are more complicated. They require a different printhead, control logic and other modifications. They are also significantly more expensive than comparable one-color printers. Heretofore there has been no mechanism or system which would give a standard one-color printer the capability of printing in two or more colors. In particular there has been no such device or system which could be readily attached to existing printers.

It is therefore a principal object of this invention to provide a mechanism that allows a conventional one color printer to print in multiple colors.

Another principal object is to provide such a multicolor capability with no alterations or only minor alterations in the construction of the conventional printer.

A further object is to provide conversion between colors during a printing operation under the control of a computer or data source.

Another object of this invention is to provide a mechanism with the foregoing advantages which has a comparatively low cost of manufacture.

A further object is to provide such a mechanism which is replaceable and which does not interfere with the normal printing operation.

Yet another object is to provide a multicolor capability which allows an "initialization" to ensure that the printing operation begins with a predetermined color.

A further object is to provide a mechanism with the foregoing advantages that is compact and reliable.

SUMMARY OF THE INVENTION

An assembly for an impact printer that allows printing in two or more colors is carried on a linearly translating printhead of the printer. The assembly is mounted so that it is movable vertically with respect to the printhead between a succession of stable vertical positions. The printer operates in conjunction with an inked ribbon that has at least two distinct, longitudinally extending bands or portions carrying inks of different colors. The assembly includes ribbon guides that direct the ribbon between the printhead and a sheet of paper being printed. The separation among the vertical positions of the assembly are correlated with the locations and dimensions of the colored portions of the ribbon so that each vertical position results in printing in a color uniquely associated with that position.

The assembly includes a mechanical arrangement for converting the movement of the printhead and the multicolor assembly to a predetermined position (typically at or near one extreme margin of the paper) into a change in the vertical position of the assembly. This mechanical arrangement also secures the assembly in the selected vertical position during subsequent printing and allows for an "initialization" procedure that guarantees that the assembly is in a known one of the vertical positions.

In a preferred form, the assembly has a frame which is mounted for a vertical sliding movement on a set of pins secured to the printhead. The frame supports the mechanical arrangement which can take the form of a pair of mutually rotatable cams with mating, saw-tooth or "mountain range" configured teeth that act as the cam surfaces. Preferably one cam is fixed and the other is rotatable. A pawl, mounted for a longitudinal sliding movement in the frame, is operatively engaged to a ratchet wheel that is secured to the rotatable cam. The pawl extends generally along the path of travel of the printhead and projects from the assembly toward an abutment surface, preferably a wall portion of the printer frame. The dimensions of the pawl and the location of the pawl and the abutment surface are such that when the printhead moves to one margin of the paper the pawl strikes the abutment surface and travels a sufficient distance to rotate the ratchet and the associated cam from one stable vertical position to another. In a two color form, one stable position corresponds to the mating of the cams being intermeshed and the other stable position corresponds to the teeth of one cam resting in small notches formed in opposed teeth of the other cam. In the latter position, a small rotation of the cams results in the teeth disengaging from the notches and moving to the fully intermeshed position. A small movement of the pawl therfore "initializes" the assembly by placing the cams in the fully intermeshed position. Also in the preferred form, the cams are biased toward one another and the pawl is biased toward the abutment surface.

These and other features and objects of this invention will be more fully understood from the following detailed description which should be read in light of the accompanying drawings.

DETAILED DESCRIPTION OF THE PREFERRED EMBODIMENTS

Figure 1:
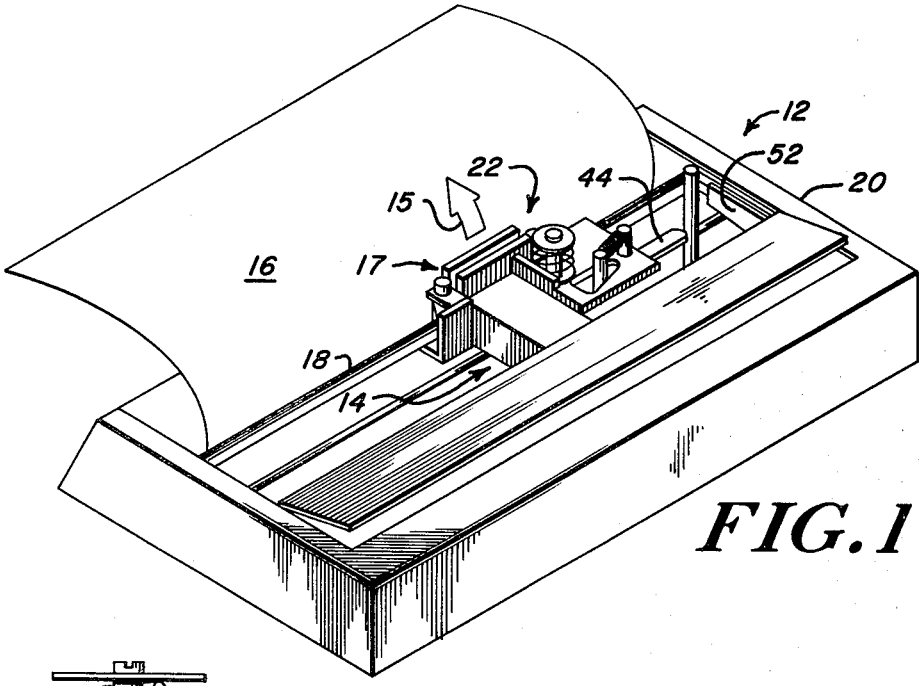
FIG. 1 is a perspective view of a conventional computer controlled impact printer utilizing multicolor ribbon and a replaceable multicolor assembly according to this invention.

FIG. 1 shows a typical impact printer 12 used as an output device for a computer or a data source (not shown). The printer 12 includes a printhead 14 which moves back and forth along a straight line path that is generally transverse to the direction of movement (arrow 15) of a sheet of paper 16 used in the printer. An inked ribbon 18 is housed within a frame 20 of the printer and moves generally along its length over a path which carries it to an impact point 17 between the printhead 14 and the paper 16. The host computer or data source controls the movement of the printhead and the advance of the paper to print the desired text line-by-line. Typically the sheet will contain a maximum of 75 to 80 columns of characters on each line.

The computer or data source also controls the selection of a character, typically an alpha numeric character or punctuation mark, which is selected in the printhead and impacts upon the side of the ribbon adjacent the printhead. The impact drives the ribbon against the paper causing an image of the selected character to be printed on the paper. Representative printers of the type described are sold by the Centronics Data Products Corporation of Hudson, New Hampshire, under the trade designation Model 730 and Model 737.

A principal feature of the present invention is a detachable ribbon guide assembly 22 which can be best seen in FIGS. 2–5A. The assembly is secured to the front end of the printhead adjacent the ribbon on a pair of mounting pins 24, 24 which are secured at their lower end to the printhead and extend generally in a vertical direction. The assembly has a frame indicated generally at 26 which includes mounting holes 28 and 30 that receive the mounting pins 24, 24 to fix the location of the assembly 22 on the printhead while allowing the assembly to move vertically along the pins.

The frame includes a central portion 26*a* which generally spans the front end of the printhead in a lateral direction, a pair of adjoining side walls 26*b* and 26*c* and a pair of laterally extending and generally horizontal side flanges 26*d* and 26*e* secured to the side walls 26*b* and 26*c*, respectively. The upper surface of the flanges 26*d* and 26*a* are spaced vertically from the lower surface of the central frame 26*a* by a distance at least equal to the width of the ribbon. The mounting hole 28 is formed in the side flange 26*d*. The assembly 22 includes a set of ribbon guide pins 32, 32 and a pair of freely rotating rollers 34, 34 which guide the ribbon 18 around the outer periphery of the assembly 22 and past the impact point 17. The pins 32, 32 are fixed and have a generally vertical orientation. They extend for a sufficient distance to reliably engage and guide the ribbon through a right angle turn from an orientation generally parallel to the paper toward generally transverse to perpendicular to the paper. The rollers 34, 34 guide the ribbon through the impact area at the front end of the printhead. The rollers 34, 34 are preferably slightly tapered. The pins 32, 32, the roller 34, 34 and the horizontal surfaces of the frame 26 adjacent the ribbon also ensure that at least the portion of the ribbon carried on the assembly 22 will move vertically in conjunction with the assembly.

The assembly 22 includes a mechanical subassembly 36 which controls the vertical movement and location of the entire assembly 22 with respect to the printhead 14. The principal components of the subassembly 36 are a pair of generally cylindrical, cams 38 and 40, a ratchet wheel 42 secured to the upper cam 38, and a pawl 44 operatively coupled to the ratchet wheel. The lower cam element 40 has an integral and downwardly projecting flange 40*a* which engages an adjacent surface of the printhead carrier and prevents the rotation of the cam 40. A central stud 46 formed integrally with the cam 40 and extends upwardly through a central aperture 38*a* formed in the cam 38. The stud and aperture align the cams with respect to one another and provides an axis of rotation for the cam 38. The sides of the cams 38 and 40 terminate in opposed, mating cam surfaces 38*c* and 40*c*, respectively. The surfaces 38*c* and 40*c* both have a generally saw-tooth or "mountain range" configuration. The teeth of the cam surface 38*c* can be viewed as a set of equal sided triangles arrayed around the circumference of the cam and each terminating at a tip 38*d*. The cam surface 40*c* has an identical configuration except that the teeth are oppositely directed and the tip of each tooth has a notch 40*d* which is adapted to receive a tip 38*d* in a mating relationship.

Figure 4:
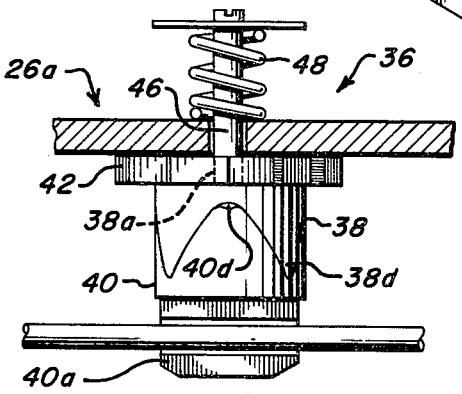
FIG. 4 is a detailed view in front elevation of the cam system of the assembly shown in FIGS. 1–3 with the cams in the lowered or fully intermeshed position.
Figure 5:
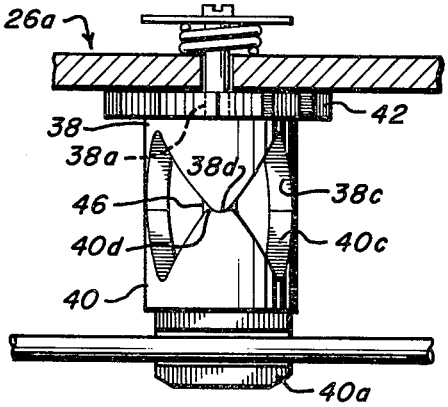
FIG. 5 is a detailed view in front elevation corresponding to FIG. 4 but with the cams in the raised position.
Figure 5A:
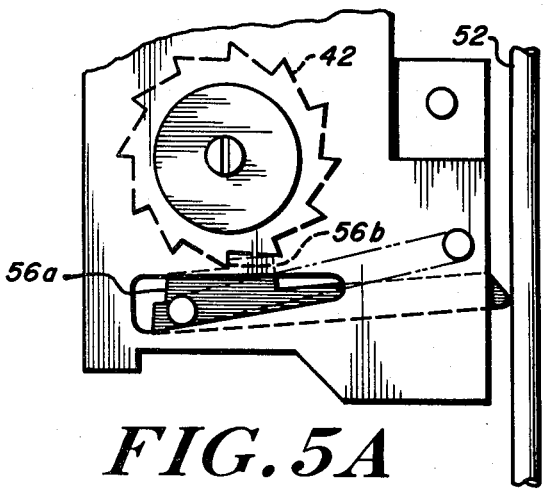
FIG. 5A is a fragmentary top plan view corresponding to FIG. 4A but with the operative elements in a position that places the cams in the position shown in FIG. 5.
Figure 2:
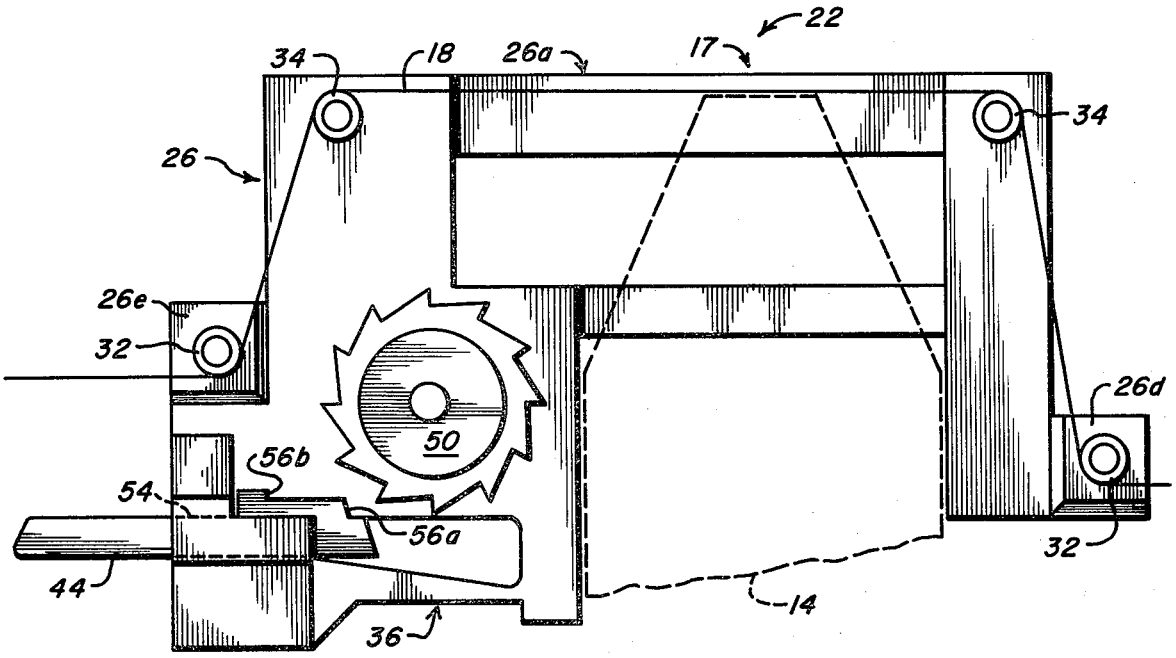
FIG. 2 is a bottom plan view of the multicolor assembly shown in FIG. 1.
Figure 3:
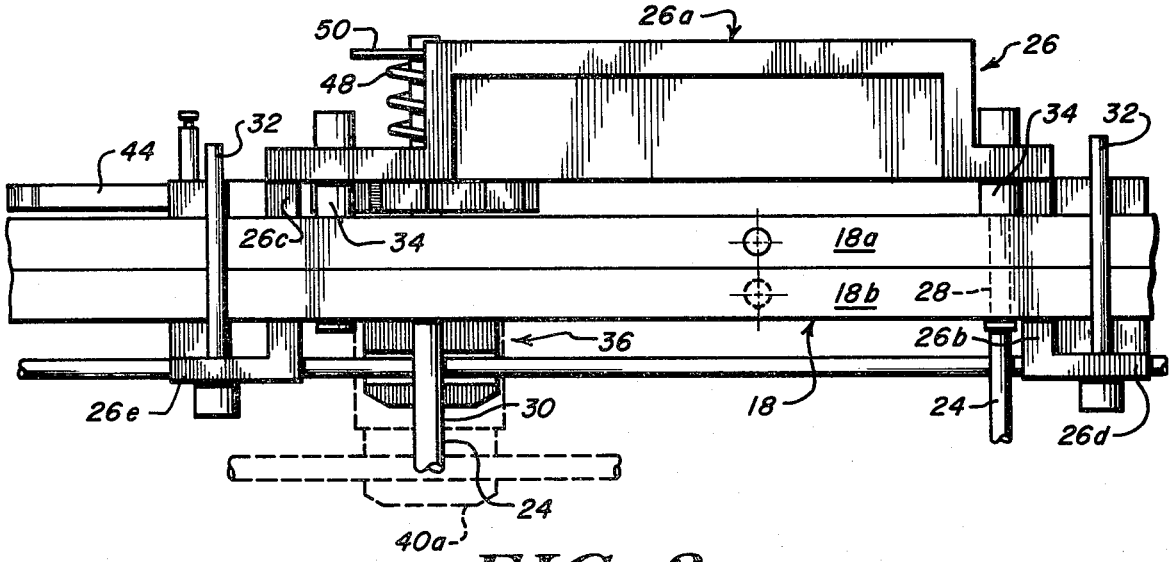
FIG. 3 is a view in front elevation of the assembly shown in FIGS. 1 and 2.

When the cams 38 and 40 are mutually rotated they move between two stable vertical positions. The first or "lowered" position exists when the teeth are fully intermeshed as shown in FIG. 4. The second or "raised" position occurs when the tips 38*d* of the cam 38 are engaged in the notches 40*d* of the cam 40 as shown in FIG. 5. A slight rotation of the cams will dislodge the tip 38*d* from the notch 40*d*. The weight of the assembly 22 as well as a biasing spring 48 will then drive the cams into the lowered position. The spring 48 is secured between a retaining washer 50 on the free end of the stud 46 and the upper wall 26*a* of the frame.

The movement of the assembly 22 between lowered and raised positions (corresponding to the lowered and raised positions of the cam elements 38 and 40) is under the control of the computer or data source controlling the movement of the printhead. More specifically, a change from one position to another occurs when the printhead and the assembly 22 carried on the printhead travel to a predetermined location at one end of the permitted travel of the printhead. In this position the pawl 44 strikes and is moved longitudinally by an abutment surface 52 which, as shown, is a portion of the ribbon guide wall of the printer frame 20.

Figure 4A:
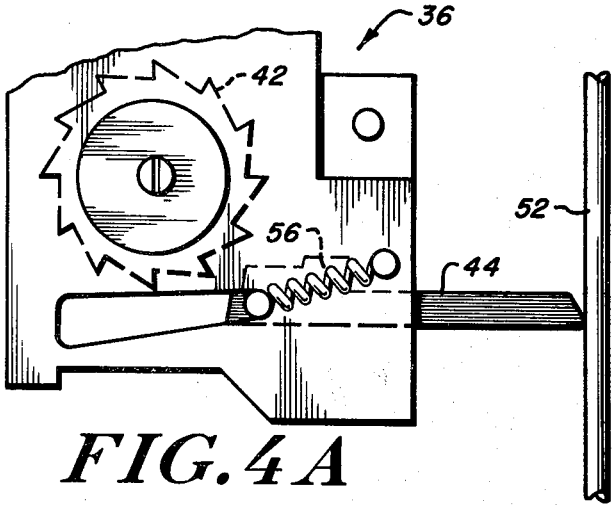
FIG. 4A is a fragmentary top plan view of the pawl, ratchet wheel, and abutment surface corresponding to FIG. 4.

The pawl 44 is held in a channel 54 which orients the pawl in a direction generally aligned with the movement of the printhead and allows a longitudinal reciprocation of the pawl against the bias of a spring 56 (FIG. 4A) secured between the pawl and the frame portion 26*a*. The pawl contains two notches 56*a* and 56*b* which are adapted to engage the teeth on the ratchet wheel 42 which is secured to or formed integrally with the upper rotatable cam 38. During a maximum displacement of the pawl when the printhead travels to its extreme marginal position the ratchet wheel undergoes a rotation through a predetermined angular displacement. The value for this angular displacement depends on the dimensions and configurations of the cam surfaces 38*c* and 40*c*. A maximum displacement of the pawl and a corresponding rotation of the ratchet wheel carry the rotatable cam 38 from one stable vertical position to the next successive stable vertical position. For the two position cam shown, a full translation of the pawl carries the cam 38 through a rotation of approximately 60 degrees. This rotation carries the cam 38 from the fully lowered position to the fully raised position or from the fully raised position to the fully lowered position, depending upon the initial vertical position of the cams prior to the operation of the pawl.

For two color operation with the assembly shown in FIGS. 1-5A, the ribbon 18 has an upper and lower bands or portion 18*a* and 18*b* which are each impregnated with an ink of a different color, typically black and red. When the cams 38 and 40 are rotated into the lowered position, the black portion of the ribbon is located under the impacting character of the printhead and therefore a black colored character will be printed on the paper. When the cams 38 and 40 are in the raised vertical position, the lower half of the ribbon will be before the impacting character of the printhead and therefore a red colored character will be printed on the paper. The vertical position of the assembly 22 carrying the ribbon 18 past the printhead therefore controls the choice of color being printed on the paper 16.

To change the color, a control signal drives the printhead to a predetermined position (e.g. one corresponding to an extreme righthand column of the paper such as column 80) which is designed to depress the pawl the distance required to change the cam orientation from one position to the other. It should be also noted that this color change can occur at any point during the printing process since the instruction can be given to drive the printhead to the appropriate color changing position and then the printhead can be returned to an intermediate column in the same line to continue printing in the newly selected color.

This invention is also conducive to an "initializing" procedure which can guarantee that the assembly 22 is in one color position or the other. This procedure involves translating the printhead to a position short of the position which would change colors (e.g. to column 78 rather than column 80). This initializing movement of the printhead will cause a short stroke of the pawl and a corresponding small rotation of the ratchet and cam 38. If the cam is in the raised position the rotation will be sufficient to dislodge the tip 38*d* from the notch 40*d*. The cam 38 will then fall into the lowered position. If the cams are already in the lowered position, the initializing procedure will slightly raise the cams but then allow them to fall back to the initial fully intermeshed or lowered position. This "initializing" capability is particularly important at the beginning of a printing operation where the assembly can be in either of two positions and the computer program or data source will not necessarily have information as to the actual position of the assembly.

While the invention has been described with respect to a preferred, two color embodiment, it will be readily understood that the principles described herein can be extended to operation with three, four or more colors through the use of more complicated cam surfaces and multicolored ribbons. Further, while one particular configuration for the cam surfaces has been described, it should be understood that other cam arrangements are also possible. For example, the mating cam surfaces can have two substantially horizontal portions connected by ramp portions such that the cams move between a intermeshed or lowered position and a raised position but that a change from one position to another requires a rotation of 180 degrees. With this cam configuration the above described initialization procedure will not be possible. Other alternatives include the use of a fixed pawl secured to the frame assembly or one mounted on the printhead as opposed to the ribbon guide assembly 22. More generally, various mechanical arrangements can be devised to convert a linear movement of the printhead to a preselected position into an incremental vertical movement of a ribbon guide assembly between two or more predetermined and stable vertical positions. These and other variations and modifications which occur to those skilled in the art with the foregoing description and drawings are intended to fall within the scope of the appended claims.

What is claimed is:

1. In a printer with a printhead that travels horizontally in a path adjacent a sheet of paper and a printing ribbon that moves between the printhead and the paper, the ribbon having at least two discrete, longitudinally extending portions each impregnated with an ink of a different color, the improvement comprising a frame, means for mounting said frame on said printhead to allow a vertical movement of the frame with respect to the printhead, guide means carried on said frame for directing the ribbon to a position between the printhead and the paper, and mechanical means secured to said frame for transforming a generally linear motion of said frame along said path into a vertical movement of said frame, guide means and the length of ribbon carried in said frame and guide means between at least two predetermined, stable vertical positions, each of said positions placing one of said ribbon color portions before said printhead to print in the color of that portion, said mechanical means comprsing an opposed pair of generally cylindrical cams that are mutually rotatable about a common, vertical axis of rotation, and each having a cam surface formed on their opposed end faces, said cam surfaces being operatively engaged with one another so that said mutual rotation carries said cam surfaces through a rotating, sliding engagement that moves said cams and said frame on which said cams are secured between said at least two predetermined vertical positions, one of said cams being fixed against rotation and the other of said cams being rotatable in response to a displacement of said print head along said path.

2. The improvement of claim 1 wherein the mating cam surfaces of said cams have a generally saw-tooth configuration.

3. The improvement according to claim 2 wherein said securing means comprises notches formed in the tips of the teeth of one of said cams, said notches being adapted to secure the cams in a spaced apart relation corresponding to one of said predetermined vertical positions.

4. The improvement according to claim 1 wherein said mechanical means includes a ratchet secured to said rotatable cam and a pawl operatively coupled to said ratchet.

5. The improvement according to claim 4 wherein said mechanical means includes an abutment surface located to engage one end of said pawl when said printhead is at or near said at least one predetermined positions and includes means secured to said frame for mounting said pawl for a longitudinal sliding movement.

6. The improvement according to claim 5 wherein said pawl is biased toward said abutment surface.

7. The improvement according to claim 5 wherein said mechanical means includes means for biasing said cams toward one another.

8. The improvement according to claim 5 wherein said pawl is biased toward said abutment surface.

9. The improvement according to claim 5 wherein said mechanical means includes means for biasing said cams toward one another.

10. The improvement according to claim 1 further comprising replaceable mounting means including a set of vertically oriented pins secured to said printhead and an aligned set of openings in said frame that receive said pins, said pins guiding said frame during said vertical movement.

11. In a printer with a printhead that travels horizontally in a path adjacent a sheet of paper and a printing ribbon that moves between the printhead and the paper, the ribbon having at least two discrete, longitudinally extending portions each impregnated with an ink of a different color, the improvement comprising a frame, means for replaceably mounting said frame on said printhead to allow a vertical movement of the frame with respect to the printhead, guide means carried on said frame for directing the ribbon to a position between the printhead and the paper, and means secured to said frame for moving said frame, guide means and the length of ribbon carried in said frame and guide means between at least two predetermined, stable vertical positions, each of said positions placing one of said ribbon color portions before said printhead to print in the color of that portion, said frame moving means comprising (i) an opposed pair of generally cylindrical cams that are mutually rotatable about a common vertical axis of rotation, and each having a cam surfaces formed on their opposed end faces that operatively engage on another and have a generally saw-tooth configuration and notches formed in the tips of the teeth of one of said cams, said notches being adapted to secure the cams in a spaced apart relation corresponding to one of said predetermined vertical positions, said mutual rotation carrying said saw tooth cam surfaces through a rotating, circumferential sliding engagement that moves said cams and said frame on which said cams are secured between said at least two predetermined positions, (ii) ratchet means secured to one of said cams and a pawl operatively coupled to said ratchet and mounted on said frame for a longitudinal sliding movement with respect to said frame, and (iii) an abutment surface located to engage one end of said pawl when said printhead is at or near at least one predetermined horizontal position on its travel path, said frame moving means operating in response to the travel of said printhead to said at least one predetermined horizontal position.

12. The improvement according to claim 11 wherein said replaceable mounting means comprises a set of pins secured to said printhead and an aligned set of openings in said frame.

* * * * *